United States Patent [19]

Thoburn et al.

[11] Patent Number: 4,821,476

[45] Date of Patent: Apr. 18, 1989

[54] DEMOUNTALE PARTITIONING SYSTEM

[75] Inventors: John G. Thoburn, March; Keith G. Longhurst, Peterborough, both of England

[73] Assignee: Phoenix Interiors Limited, Cheam Surrey, England

[21] Appl. No.: 528,924

[22] Filed: Sep. 2, 1983

[30] Foreign Application Priority Data

Sep. 7, 1982 [GB] United Kingdom ..... 8225442

[51] Int. Cl.[4] ..... E04B 2/58

[52] U.S. Cl. ..... 52/238.1; 52/282; 52/397; 52/399; 52/738

[58] Field of Search ..... 52/238.1, 282, 397, 52/775, 235, 239, 738, 739

[56] References Cited

U.S. PATENT DOCUMENTS

| | | | |
|---|---|---|---|
| 2,197,913 | 4/1940 | Axe | 52/399 |
| 2,282,831 | 5/1942 | Shutts | 52/788 |
| 2,348,307 | 5/1944 | Richardson | 52/788 |
| 3,016,993 | 1/1962 | Owen | 52/397 |
| 3,140,763 | 7/1964 | Edelstein | 52/235 |
| 3,209,869 | 10/1965 | Hammitt | 52/239 |
| 3,221,453 | 12/1965 | Lietaert | 52/235 |
| 3,261,625 | 7/1966 | Cripe | 52/239 |
| 3,358,410 | 12/1967 | Dawdy | 52/282 |
| 3,370,389 | 2/1968 | Macalvuso | 52/239 |
| 3,371,454 | 3/1968 | Anderson | 52/239 |
| 3,559,357 | 2/1971 | Lowe | 52/282 |
| 3,690,079 | 9/1972 | Hemminger | 52/235 |
| 3,719,014 | 3/1973 | Sukolics | 52/235 |
| 3,733,759 | 5/1973 | Schulte | 52/239 |
| 3,749,432 | 7/1973 | Janssen | 52/238.1 |
| 3,900,966 | 8/1975 | Suarez | 52/399 |
| 4,109,429 | 8/1978 | Whisson | 52/239 |
| 4,263,764 | 4/1981 | Wendt | 52/489 |
| 4,333,286 | 6/1982 | Weinar | 52/489 |
| 4,458,461 | 7/1984 | Holley | 52/282 |
| 4,463,530 | 8/1984 | Albert | 52/171 |
| 4,467,579 | 8/1984 | Weinar | 52/489 |

FOREIGN PATENT DOCUMENTS

| | | | |
|---|---|---|---|
| 2060889 | 6/1971 | Fed. Rep. of Germany | 52/399 |
| 581274 | 8/1974 | Switzerland | 52/282 |
| 2126621 | 3/1984 | United Kingdom | 52/127.1 |

*Primary Examiner*—John E. Murtagh

*Attorney, Agent, or Firm*—Pollock, Vande Sande & Priddy

[57] ABSTRACT

A demountable partitioning system comprises multipurpose aluminum extrustions adapted to be snap-fitted together in a number of different configurations to suit different constructional and system design requirements. The system centers around two universal sections (FW1,FW11) each in the form of a rectangular channel open at one side and provided with formations (3,4,5) enabling other extrustions selected from a glazing infill section (FW3), a blank end section (FW4), and a door infill section (FW5) each provided with complementary formations (8,10) to be snap-fitted onto one or more sides of the universal section (FW1,FW11). Extruded aluminum plastic or glazing channels (FW6,FW7,FW8) capable of engaging with a number of different glazing beads (FG) can be snap-fitted with the universal sections (FW1,FW11) and with the glazing infill (FW3) for assembling single or double glazing as desired to the universal sections (FW1,FW11). The universal sections (FW1,FW11) also can engage with wall panels of a partitioning installation. Fixing clips (FS1,FS2,FS3 and FS4) enable gapless panel joints to be made, and the system further includes corner and reducing sections (FW9,FW10) and wiring ducting sections (FW13,FW14,FW15).

30 Claims, 13 Drawing Sheets

FIG.1.
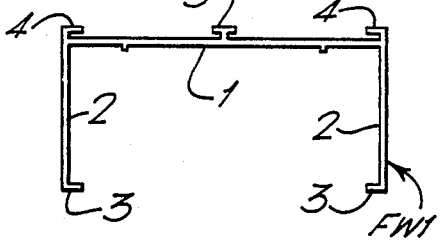
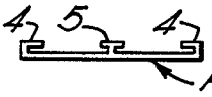
FIG.2.
FIG.3.
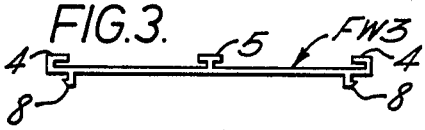
FIG.4.
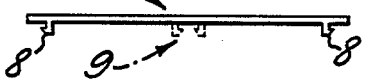
FIG.5.
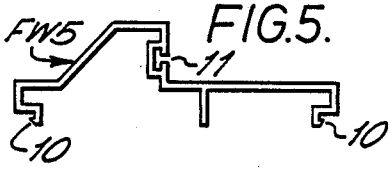
FIG.6.
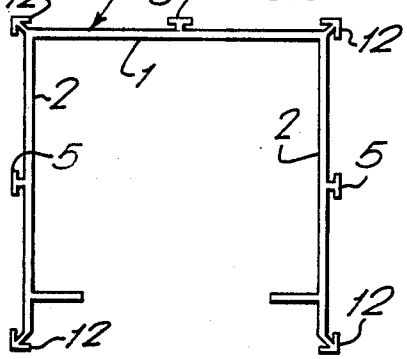
FIG.7.1
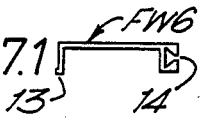
FIG.7.2
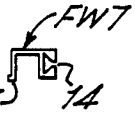
FIG.7.3
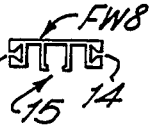
FIG.9.1
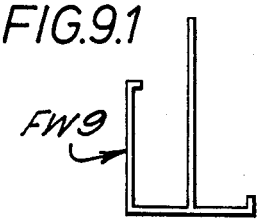
FIG.9.2
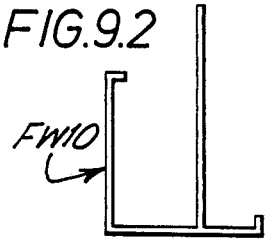
FIG.8.1
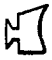
FIG.8.2
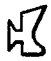
FIG.8.3
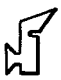

FIG.10.1
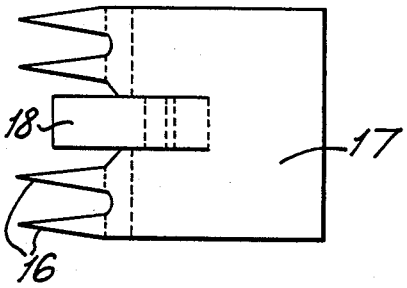
FIG.10.2
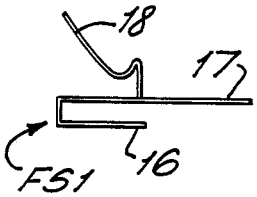
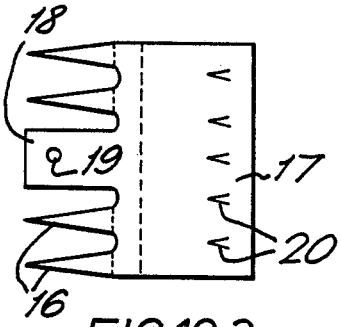
FIG.10.3
FIG.10.4
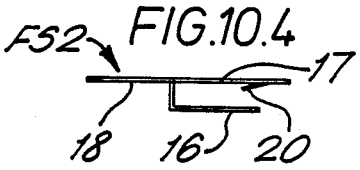
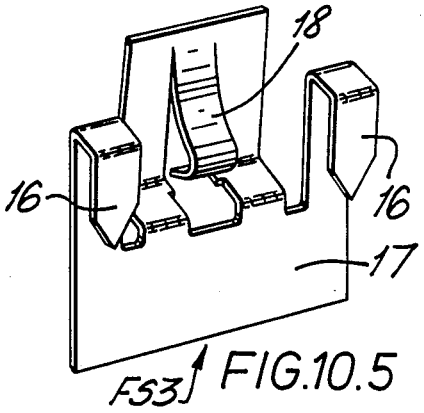
FIG.10.5
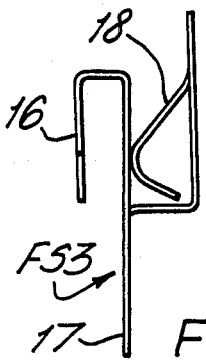
FIG.10.6

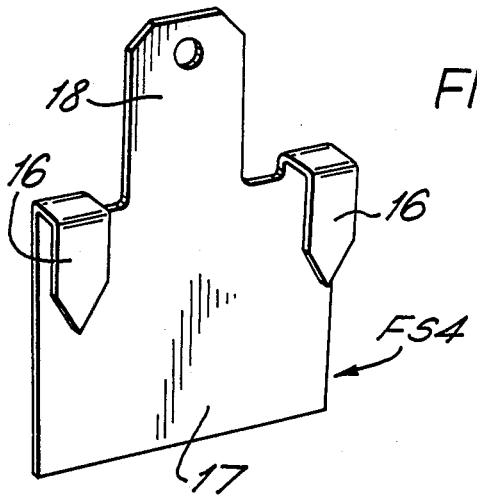
FIG.10.7
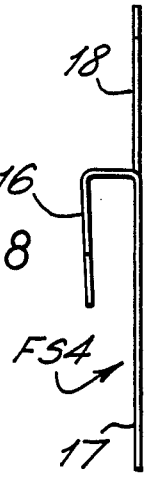
FIG.10.8
FIG.10.9.
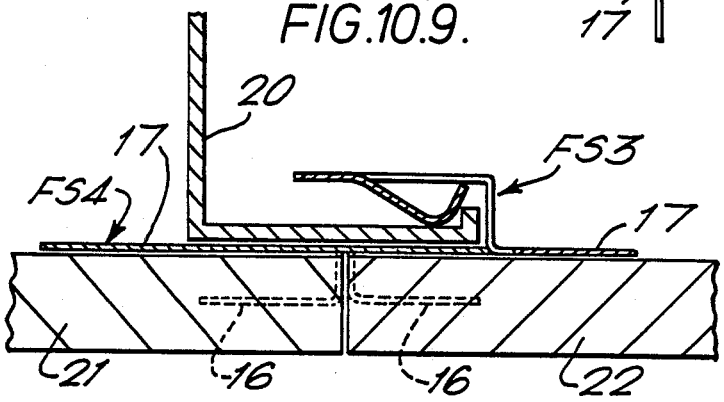

FIG.11.1
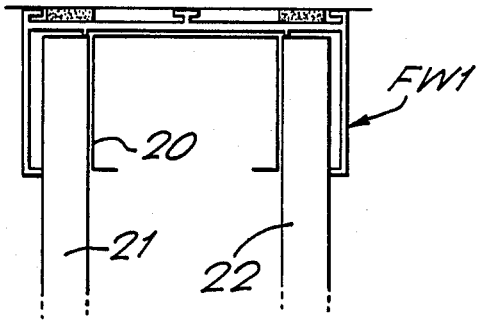
FIG.11.2
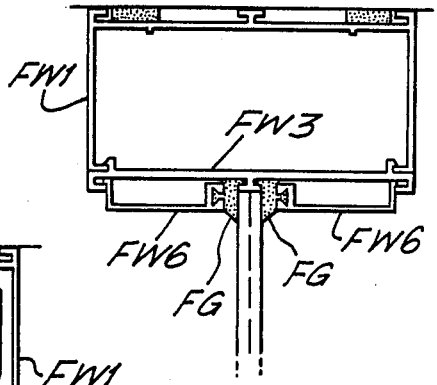
FIG.11.3
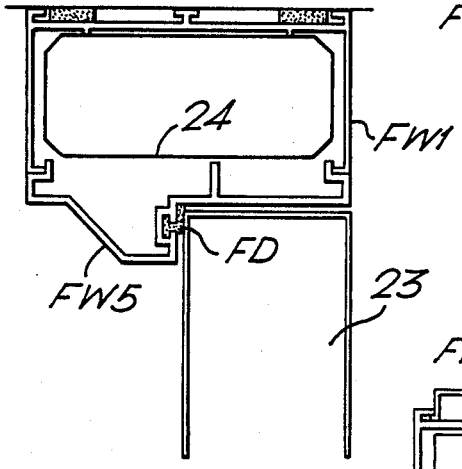
FIG. 11.4
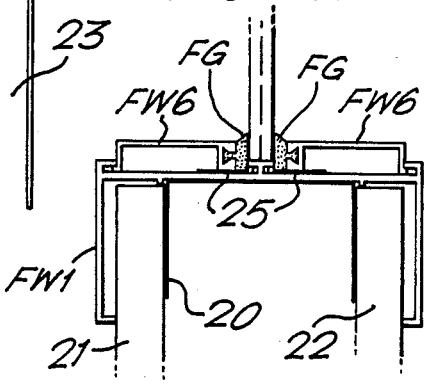

FIG.11.7
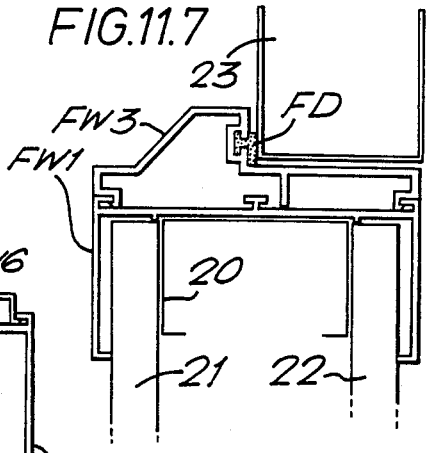
FIG.11.5
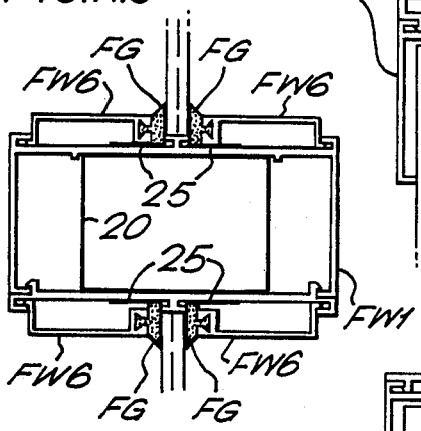
FIG.11.8
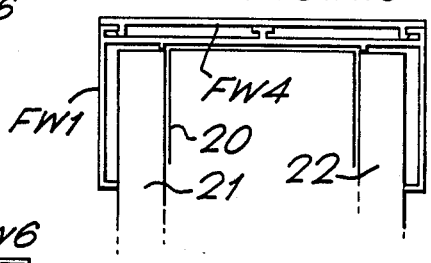
FIG.11.6
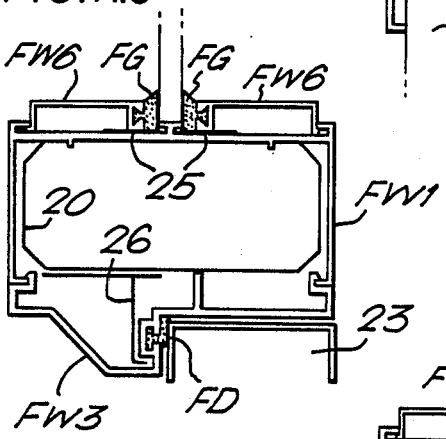
FIG.11.9
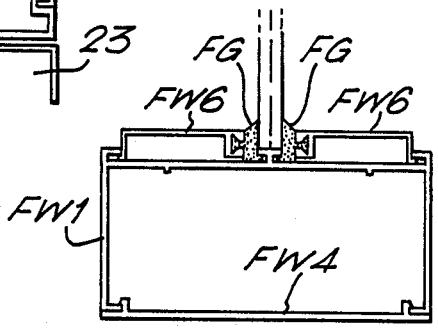

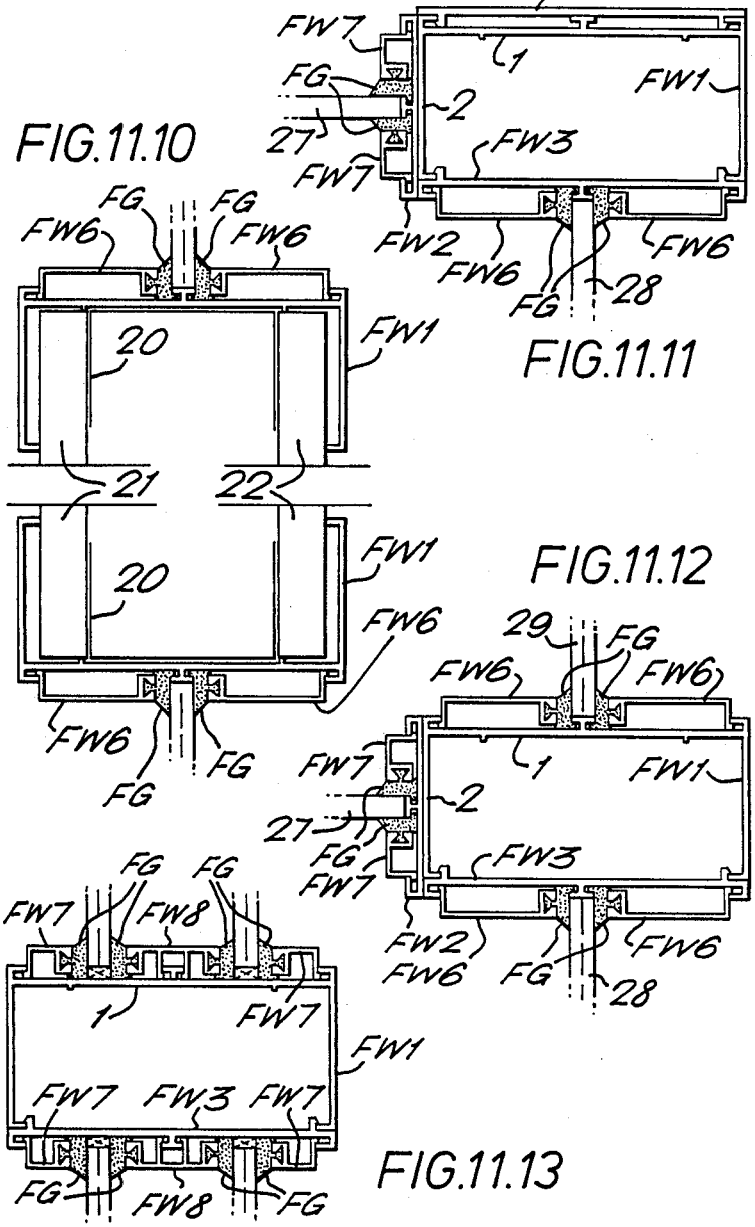
FIG.11.10
FIG.11.11
FIG.11.12
FIG.11.13
FW4
FW7
FG
1
FW1
2
27
FW3
FW2
FW6
28
29
FW8
20
21
22

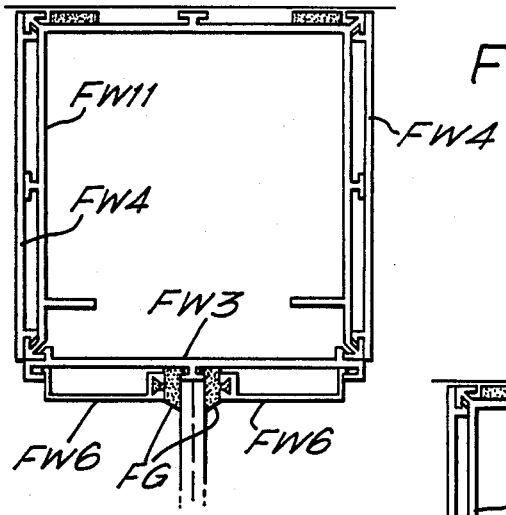
FIG.12.1
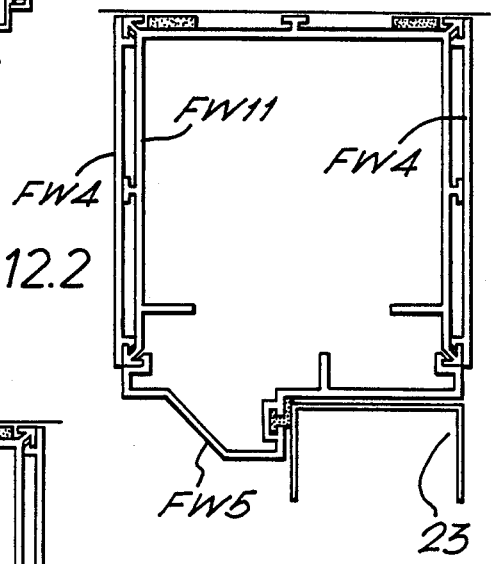
FIG.12.2
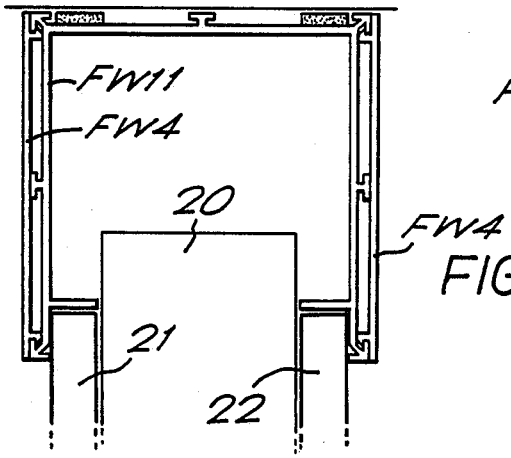
FIG.12.3

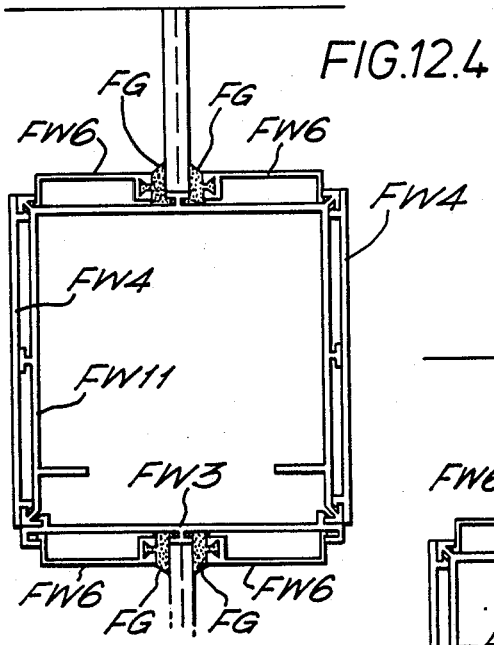
FIG.12.4
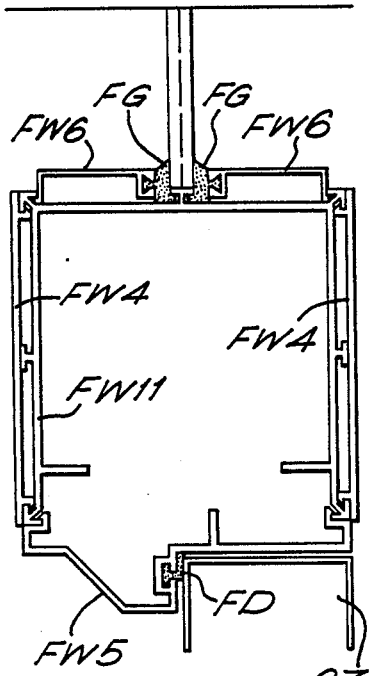
FIG.12.5
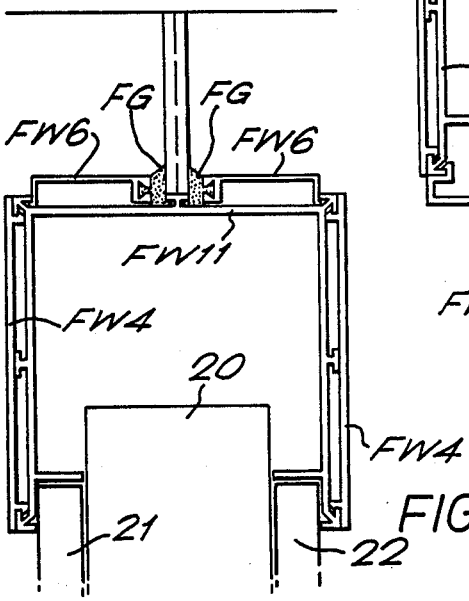
FIG.12.6

FIG.12.7
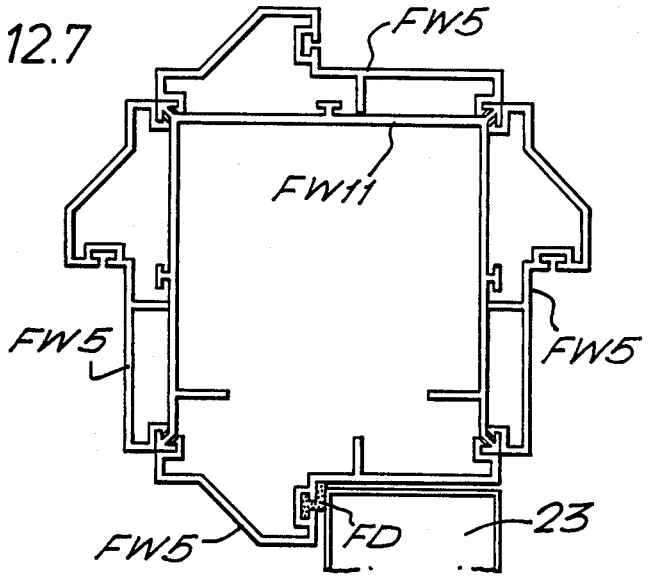
FIG.12.8
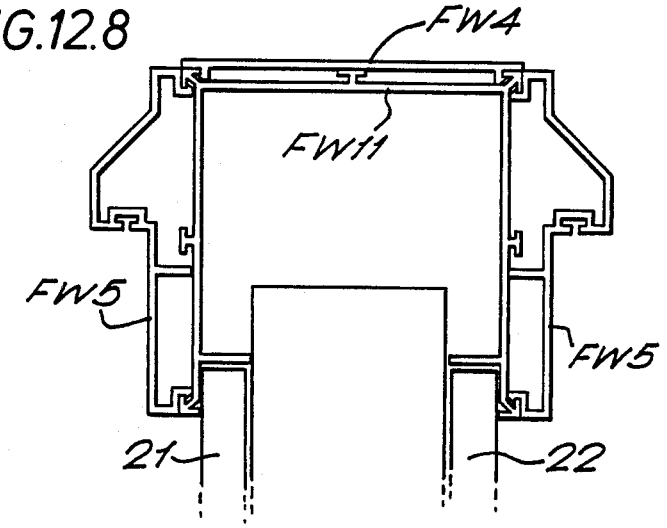

FIG.12.9
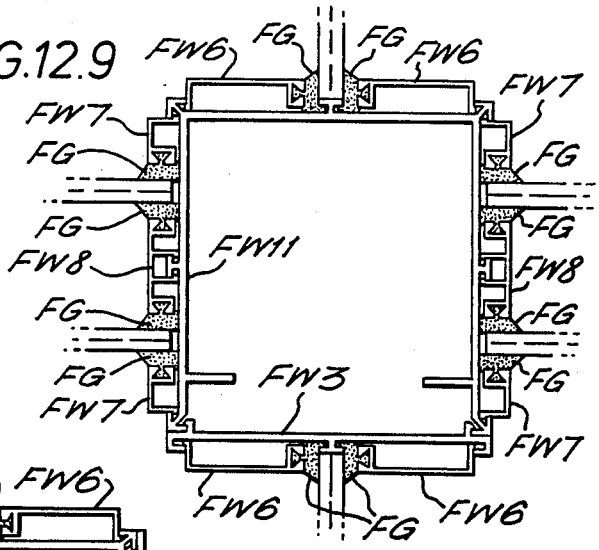
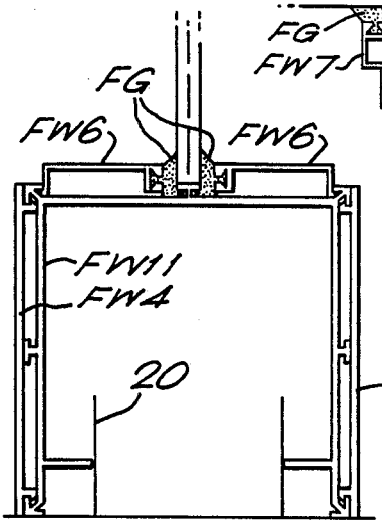
FIG.12.10
FIG.12.11
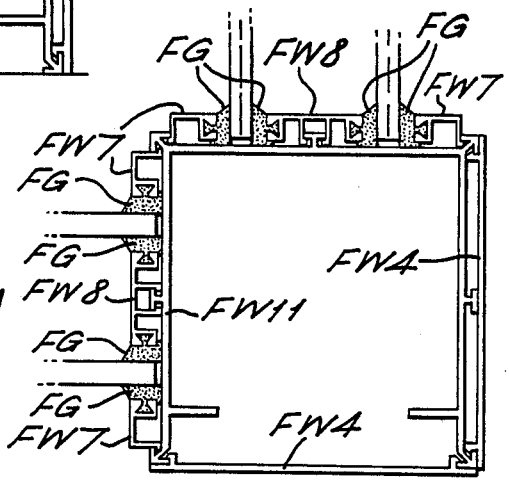

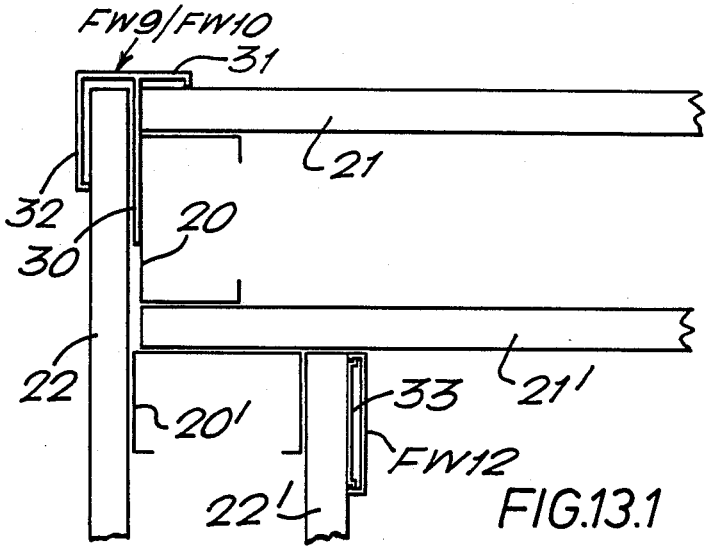
FIG.13.1
FIG.13.2
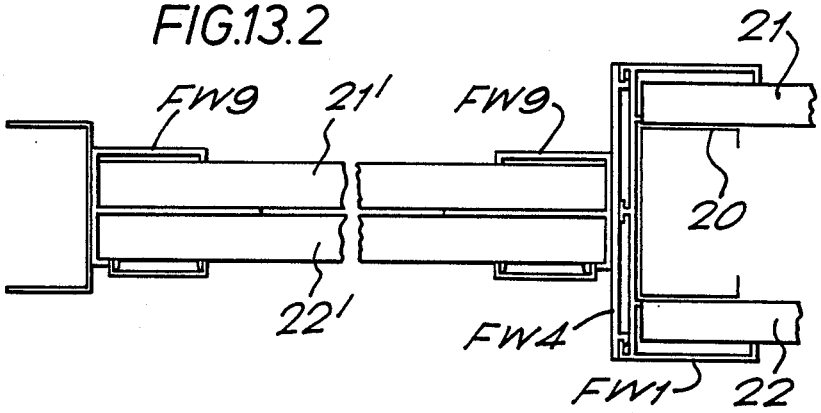

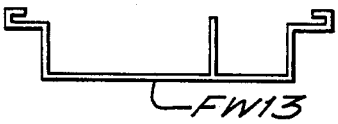
FIG.14
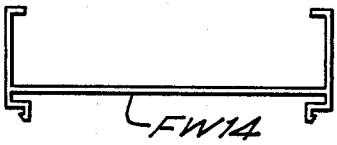
FIG.15.
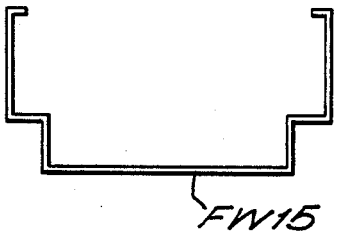
FIG.16
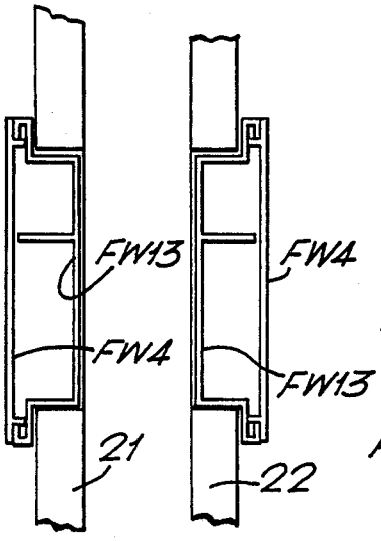
FIG.17.1
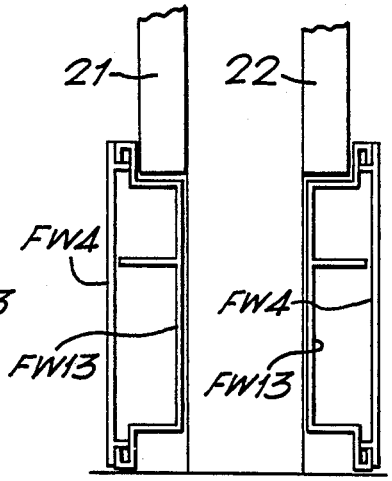
FIG 17.2.

DEMOUNTALE PARTITIONING SYSTEM

FIELD OF THE INVENTION

This invention concerns improvements relating to demountable partitioning systems as widely used, for example, in office buildings to enable the arrangement of rooms within a determined floor space to be varied at the will of the occupant. Such systems are well known and generally comprise a multiplicity of sections of extruded aluminum for example each designed for one function only or, at best, for a dual function.

SUMMARY OF THE INVENTION

The present invention provides a family of sections designed to interact with one another in multi-functional manner, which reduces the overall number of different sections required to install a partition wall incorporating one or more doors, one or more wall panels, and one or more single and/or double glazed windows as its major constituent parts. The invention centers on the provision of a universal section adapted to be used alone for certain operations, and coupleable for other applications to other sections such as a blank end infill, a glazing section or infill or a door frame infill for example, in which case other sections such as single or double glazing channels, glazing beads, etc., may be engaged with the universal section and/or with the coupled on other section or sections.

In accordance with one aspect of the invention, therefore there is provided a universal section for a demountable partitioning system, said universal section comprising an elongate channel-shaped member of constant, generally rectangular cross-section throughout its length, the said member being open on one side and having formations associated with at least one other side such as to enable another elongate member having complementary formations to be engaged with the said one other side in a snap-fit manner.

An exemplary embodiment of the universal section according to the invention comprises an aluminum extrusion of generally rectangular cross-section having a base wall, a pair of side walls and an open side, a glazing stool extending longitudinally of the channel-shaped member on the outer side of the base wall intermediate the two side edges of the base, the said glazing stool being undercut on both sides facing the edges of the base, and a pair of formations being provided extending along the two side edges of the base wall externally of the channel-shaped member, the said formations being undercut on their sides facing towards the undercut sides of the glazing stool, and formations being provided at the edges of the two side walls of the channel-shaped member between which the open side of the channel-shaped member is defined, the formations at the external edges of the base wall being spaced apart from one another a distance substantially equal to the spacing apart of the formations at either side of the open side of the channel-shaped member, and being similarly shaped thereto for enabling the attachment to the base wall and/or to the open side of the channel shaped member of similarly configured further members having complementary formations. In an alternative embodiment, the two side walls also have external formations the same as those on the base wall.

In use of the above-described exemplary embodiment, the universal section is combined with one or more other sections having formations complementary to the formations on the elongate channel-shaped member, said one or more other sections being engaged with one or more of the walls of the elongate channel-shaped member and/or with the open side thereof by snap-fitting together of the complementary formations of the respective parts, said one or more other sections being selected from the following:

(a) single-glazing glazing elements each with an associated glazing bead and comprising an elongate element adapted to be snap-fitted between the undercut of a glazing stool and the facing undercut of an edge formation of the universal section for locating a glazing pane supported on said glazing stool;

(b) double-glazing glazing elements comprising an elongate inner glazing element having associated glazing beads along both edges and elongate outer glazing elements having an associated glazing bead along one edge only, the inner glazing element being adapted to be engaged with a glazing stool between two glazing panes and the outer glazing elements being adapted to be engaged with the undercut of a respective edge formation and between such formation and a respective one of the two glazing panes;

(c) glazing infill elements comprising elongate and generally planar strip-like elements having on one side thereof formations engageable with the formations of the channel-shaped member and on the other side thereof formations substantially the same as the formations provided at least on the base wall of the channel-shaped member;

(d) blank end sections comprising elongate and generally planar elements having on one side thereof formations engageable with the formations of the channel-shaped member, the other side being plain;

(e) door infill sections comprising elongate elements having on one side formations engageable with the formations of the channel-shaped member and on the other side being shaped to define an abutment for a door; and (f) wiring ducts comprising generally channel-shaped elongate elements provided with formations engageable with the formations of the channel-shaped universal section.

A demountable partition can thus be constructed which comprises one or more universal sections as above described which provide support, both horizontally and/or vertically, for partition sections selected from the following:

(a) single-glazing glazing panels;
(b) double-glazing glazing panels;
(c) solid partition wall panels; and
(d) doors with the layout of such partitions being variable at the discretion of the layout designer.

According to another aspect of the invention, a demountable partition comprises partition sections selected from the group comprising single-glazed glazing panels, double-glazed glazing panels, solid wall panels, and doors, in combination with multiple-function universal sections constituting primary supports for the partition sections and interfacing with respective ones of the partition sections by means of interfacing sections clipped in respective side walls of the universal sections in snap-fit manner, the universal sections and the interfacing sections being provided with complementarily-shaped inter-engageable formations enabling such clipping together of the respective sections and the interfacing sections being selected from the group comprising single-glazing and double-glazing glazing sections, blanking sections, door frame sections, and ducting sections.

The invention extends furthermore to a method of erecting a demountable partition comprising partition sections selected from the group comprising single-glazed glazing panels, double-glazed glazing panels, solid wall panels, and doors, the said method comprising utilizing multiple-function universal sections as primary supports for the partition sections and interfacing the respective partition sections with their supporting universal sections by clipping appropriate interfacing sections to the respective supporting universal sections, the universal sections and the interfacing sections being provided with complementarily-shaped inter-engageable formations for enabling such clipping together of the respective sections, the interfacing sections being selected from the group comprising a single-glazing and double-glazing glazing sections, blanking sections, door infill sections and ducting sections.

According to another of its aspects, the invention provides a method of supporting a butt joint between two generally coplanar wall panels of a demountable partitioning system by means of metal clips comprising a generally flat body portion having a forwardly projecting nose portion and one or more rearwardly projecting teeth portions connected to the body portion with a spacing therefrom, the nose portion and teeth portions extending generally parallel to the body portion, the method comprising attaching a plurality of said clips to the edge of each of said two panels with the teeth portions of each clip embedded in the panel edge and the body portion closely adjacent the panel surface so that the nose portion projects from the panel edge generally in the plane of said panel surface, attaching the nose portions of the clips attached to the edge of a first panel to a support member, and abutting that edge of the second panel to which the clips are attached with the corresponding edge of the first panel with the nose portions of the clips attached to the second panel introduced behind the first panel on the same side thereof as the support member.

In accordance with a variation of the above method which avoids the necessity of using secondary fittings (e.g., rivets, screws, bolts, etc.) to secure the clips to the support member, the invention provides metal clips of a first and a second type, the first type metal clips comprising a generally flat body portion having a spring clip on one side thereof and one or more teeth portions connected to the body portion and extending generally parallel thereto with a spacing therefrom, and the second type metal clips comprising a generally flat body portion having a forwardly projecting nose portion and one or more rearwardly projecting teeth portions extending generally parallel to the body portion with a spacing therefrom, the method of use of such clips comprising attaching a plurality of said first type clips to the edge of a first one of said two panels with the teeth portions of each clip embedded in the panel edge, attaching said plurality of first type clips to a support member by engaging the support member with the spring clip portions, attaching a plurality of said second type clips to the edge of a second one of said two panels with the teeth portions of each clip embedded in the panel edge so that the nose portions of the clips project from the panel edge generally in the plane of the panel, and abutting the said edge of the second panel with the said edge of the first panel with the nose portions of the second type clips introduced behind the first panel on the same side thereof as the support member.

The invention extends also to wall panel fixing clips of the above-mentioned types.

BRIEF DESCRIPTION OF THE DRAWINGS

The invention together with features and advantages thereof will best be appreciated from consideration of the following description given with reference to the accompanying drawings, wherein:

FIG. 1 shows a cross-sectional view of a universal section in accordance with one embodiment of the invention;

FIG. 2 shows a cross-sectional view of a glazing section adapted to be coupled with the universal section of FIG. 1;

FIG. 3 shows a cross-sectional view of a glazing infill adapted to be used with the universal section of FIG. 1;

FIG. 4 shows a cross-sectional view of an end infill adapted to be coupled with the universal section of FIG. 1;

FIG. 5 shows a cross-sectional view of a door frame infill section adapted to be used with the universal section of FIG. 1;

FIG. 6 shows a cross-sectional view of a modified form of the universal section of FIG. 1 adapted for use with any of the sections of FIGS. 2 to 5;

FIGS. 7.1, 7.2 and 7.3 show cross-sectional views of glazing channels adapted for use with the sections of FIGS. 1, 2, 3 and 6;

FIGS. 8.1, 8.2 and 8.3 show cross-sectional views of glazing beads adapted for use with the glazing channels of FIG. 7;

FIGS. 9.1 and 9.2 show in cross-sectional view two different sizes of a corner or reducing section;

FIGS. 10.1 and 10.2, 10.3 and 10.4, 10.5 and 10.6, and 10.7 and 10.8 show panel clips useful with the system according to the invention and FIG. 10.9 shows a joint formed with such clips;

FIGS. 11.1 to 11.13 show examplary configurations which can be realized in demountable partitions constructed principally by use of the universal section of FIG. 1 in combination with other components;

FIGS. 12.1 to 12.11 show exemplary configurations which can be realized in demountable partitions constructed principally by use of the modified universal section of FIG. 6 in combination with other components;

FIGS. 13.1 and 13.2 show the use of the section of FIG. 9.1 in the construction respectively of a corner and of a reducing panel;

FIG. 14 shows a cross-sectional view of a board depth wiring duct useful with the system according to the invention;

FIG. 15 shows a cross-sectional view of a section which can, for example, be used with the wiring duct of FIG. 14 to form a twin, divided wiring duct;

FIG. 16 shows a cross-sectional view of a deep wiring duct section useful with the system according to the invention;

FIGS. 17.1 and 17.2 illustrate applications of the board depth wiring duct of FIG. 14;

DETAILED DESCRIPTION

Figure 18:
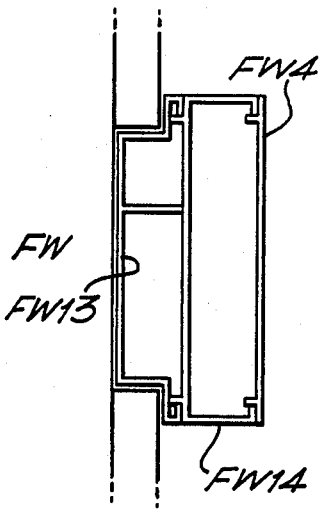
FIG. 18 illustrates an application of the board depth wiring duct of FIG. 14 with the section of FIG. 15.

Referring to FIG. 1, the universal section FW1 comprises a generally rectangular section channel open at one side and comprising a major wall 1, minor walls 2 upstanding from the major wall 1, and formations 3, 4 and 5, as illustrated. FIG. 2 shows a glazing section FW2 adapted to be secured by means of bolts, screws or adhesive to the outer surface of one or other or both of minor walls 2 of the universal section FW1 of FIG. 1 to enable such minor walls 2 to be employed for glazing, as will be described hereinafter, and it will be seen that FW2 has undercut formations 4 and 5 akin to those of FW1. The glazing infill FW3 of FIG. 3 is adapted to be snap fitted into the open side of the universal section FW1 of FIG. 1 with the lugs 8 of FW3 engaged with formations 3 of FW1, and again it can be seen that FW3 has undercut formations 4 and 5 akin to those provided on the major wall 1 of universal section FW1. FIG. 4 shows a blank end infill FW4 which not only can be fitted into the open side of universal section FW1, but also can be fitted onto major wall 1 of FW1 with the lugs 8, which are dimensioned and located relative to the unit FW4 identically to the lugs 8 of glazing infill FW3, engaged with the formations 4 of FW1 and the optionally provided pair of facing lugs 9 engaged with the formation 5 of FW1.

FIG. 5 shows a door frame infill FW5 shaped as shown and adapted to be snap-fitted either to the open side of universal section FW1 of FIG. 1 or to the major side 1 thereof, the turned edges 10 of door infill FW5 engaging with formations 3 or 4, respectively of FW1. The door infill FW5 also has a retaining groove 11 for an elastomeric seal (not shown). The door infill FW5 enables the universal section FW1 to be used as a door frame section.

FIG. 6 shows a second embodiment of the universal section adapted for use inter alia as a four way post. As shown, the section FW11 is of generally square section with one open side and three sides which are functionally identical to major side 1 of the universal section FW1 of FIG. 1 though, there are differences in the shape of the undercut corner formations 12 as compared with the corresponding formations of FW1.

The sections above-described with reference to FIGS. 1 to 6 preferably are formed of extruded aluminum which is anodized to provide a satin surface finish or may be colored as desired, but could be formed of other materials.

FIGS. 7.1, 7.2 and 7.3 show glazing channels which may be formed of extruded aluminum or of extruded plastics material and are adapted for use with the sections FW1 of FIG. 1, FW2 of FIG. 2, FW3 of FIG. 3, and FW11 of FIG. 6. The glazing channel FW6 of FIG. 7.1 is a single glazing channel having a bead 13 along one edge adapted to be engaged with the formation 4 of universal section FW1, and a retaining groove 14 extending along its opposite edge for capturing one of the PVC glazing beads of FIGS. 8.1, 8.2 or 8.3 selected in dependence upon the required glass thickness. In use of single glazing channel FW6, for example with universal section FW1 of FIG. 1, two such oppositely directed channels FW6 are used so as to sandwich the edge of the glass between the respective glazing beads with the edge of the glass seated upon or otherwise located by formation 5 serving as a glazing stool. FIG. 7.2 shows a glazing channel FW7 similar to the glazing channel FW6 but of narrower dimensions to enable the glazing section FW2 to be single glazed, and glazing channel FW7 is also adapted for use with glazing channel FW8 of FIG. 7.3 to enable the universal section FW1 of FIG. 1 to be double glazed, the section FW8 engaging formation 5 of universal section FW1 with its pair of opposed lugs 15 and a pair of sections FW7 being engaged by their edge beads 13 with the undercut formations 4 at opposite sides of the major wall 1 of section FW1, the glass panes each being sandwiched as above described at their edges between selected glazing beads.

FIGS. 9.1 and 9.2 show differently sized extruded aluminum corner sections FW9 and FW10 for use to conceal the vertical butt joint between two wall panels extending perpendicularly one to the other, it being appreciated that the panels will be retained along their top and bottom horizontal edges by other means. The sections FW9 and FW10 have other uses, as will hereinafter be described.

FIGS. 10.1 to 10.4 show two types of pressed steel panel clips useful in the construction of a demountable partition system according to the invention; FIGS. 10.1 and 10.3 show the respective clips in blank form before bending to shape and FIGS. 10.2 and 10.4 show the formed clips. The clip FS1 of FIGS. 10.1 and 10.2 has barbs 16 which are turned in under the body 17 of the clip and has a released tongue 18 which is bent as shown. The clip FS2 of FIGS. 10.3 and 10.4 has similar barbs 16 which are bent in under, and has a tongue 18 which is however not bent out of the plane of the body of the clip and is provided with a fixing hole 19. Tangs 20 are released downwardly from body portion 17 of the clip FS2. FIGS. 10.5 and 10.6 and FIGS. 10.7 and 10.8 show two further clips which in essence are modified forms of the clips of FIGS. 10.1 and 10.2 and FIGS. 10.3 and 10.4 and comprise parts referenced in FIGS. 10.5 to 10.8 with the same reference numerals as designate corresponding parts in FIGS. 10.1 to 10.4. The mode of use of the illustrated clips will be described hereinafter.

Referring now to FIGS. 11.1 to 11.13 and FIGS. 12.1 to 12.11, these illustrate the usefulness of the sections described above. It has to be understood that the system according to the invention proposes to employ standard lightweight steel sections (studs) as reinforcement within the universal sections FW1 and FW11 of FIGS. 1 and 6 respectively, and such studs are designated with the reference 20 in the drawings.

FIG. 11.1 shows a double skinned wall panel comprising boards 21 and 22 secured at their edges by means of a universal section FW1 attached to a wall, ceiling or other surface, for example by means of screws.

FIG. 11.2 shows a universal section FW1 with a glazing infill FW3 fitted thereto and with single pane glazing fitted by means of two glazing channels FW6 fitted with appropriate glazing beads FG. A second similar combination of a universal section FW1 and two glazing channels FW6 might constitute the lower transom of the window, and might have two boards 21 and 22 extend downwardly therefrom in the manner shown in FIG. 11.1.

FIG. 11.3 shows a door infill section FW5 secured in the open side of a universal section FW1 secured to a wall, ceiling or other surface, the formations 10 of FW5 being engaged with the formation 3 of FW1. A sealing strip FD engages in the channel 11 provided in door infill section FW5 for making a draught proof seal with a door 23. A reinforcing section 24 may as required be provided within the universal section FW1.

FIG. 11.4 shows a solid:glazed arrangement which might, for example, be utilized for the lower transom or for the mullion of a window. The window pane is received between glazing beads FG fitted to a pair of single glazing channels FW6 engaged with the major wall 1 of a universal section FW1, and a pair of boards 21, 22 engage with the open side of the universal section FW1. The arrangement shown is fire rated by the addition of steel angles 25 as shown in the region of the glazing beads FG.

FIG. 11.5 shows a glazed:glazed arrangement which might be employed in a window transom or mullion. The arrangement is similar to that of FIG. 11.4 except that in place of the panels 21, 22 there is a window pane glazed to a glazing infill FW3 received in the open side of universal section FW1 by means of a pair of glazing channels FW6 and associated glazing boards FG. The arrangement of FIG. 11.5 is fire rated similarly to that of FIG. 11.4.

FIG. 11.6 shows a door:glazed transom or mullion arrangement which comprises a universal section FW1, glazing channels FW6 and associated glazing beads FG, a door infill section FW5 with associated seal FD, and fire rating sections 25 and 26. FIG. 11.7 shows a door:-solid arrangement the construction whereof will be clear from the foregoing, FIGS. 11.8 and 11.9 show the application of the blank end section FW4 of FIG. 4 in solid and glazed blank end arrangements respectively, and FIG. 11.10 illustrates the construction of a chair rail (a horizontal rail in a partition wall at a height from the floor approximating the height of a chair back) in a single glazed partition wall using two opposed glazed:-solid arrangements as described with reference to FIG. 11.4.

FIG. 11.11 shows a glazed corner constructed around a universal section FW1 provided on its major wall 1 with a blank end section FW4 of FIG. 4, provided on one of its minor walls 2 with a glazing section FW2 of FIG. 2, and having a glazing infill section FW3 of FIG. 3 clipped into its open face. A first glass pane 27 is glazed to the glazing section FW2 by means of glazing channels FW7 of FIG. 7.2 with associated glazing beads FG, and a second glass pane 28 is glazed to the glazing infill FW3 by means of glazing channels FW6 of FIG. 7.1 with associated glazing beads FG. FIG. 11.12 shows a three-way glazed junction constructed similarly to the corner arrangement of FIG. 11.11 but with a third pane of glass 29 glazed to the major wall 1 of the universal section FW1.

FIG. 11.13 shows a double glazed mullion or transom and illustrates how the major wall 1 of the universal section FW1, and correspondingly the glazing infill FW3, are designed for co-operation either with glazing channels FW6 of FIG. 7.1 for single glazing applications or with double glazing outer channels FW7 of FIG. 7.2 and inner channel FW8 of FIG. 7.3.

The simplicity and flexibility of the system according to the invention will readily be appreciated from FIGS. 11.1 to 11.13.

As compared with conventional sound and fire rated partition systems which all have one thing in common, namely, the use of components which each perform a single or at most a dual function only, the system of the present invention uses a universal section FW1 which fulfills a wide variety of functions, such as use as a head channel at ceiling level or as an abutment against a wall, solid partition or column. In other applications, the section FW1 performs a function as a major component; it may be used, for example, as a single or double sided glazing mullion or transom capable of being single or double glazed, and with any combination of adjacent panels, i.e., glazed, door, or solid panel, whether vertically or horizontally. Similarly, it can be used as a door frame member against any combination of adjacent panels. It can also be used in the construction of a corner post in glazed elevations, a three-way post or a four-way post either glazed or solid, or as a finishing post either on the termination of a partition or around a clear opening or at the top of a bank rail height partition. To fulfill these functions, the only other aluminum components that are necessary and which clip fix to the universal section FW1 are the glazing infill FW3 to form a double sided mullion or transom or to glaze direct to the head channel, the end infill FW4 to form a termination or clear opening or capping to a bank rail height partition, and the FW5 door frame infill.

The plastic or aluminum glazing channels are clipped directly to FW1 to FW3, with FW6 being used for single glazing and FW7 and FW8 for double glazing, FW7 being usable also to glaze from FW2 (three way and four way).

The modified universal section FW11 of FIG. 6 is a universal four-way post with multi-functional usage. It can be used, for example, as a corner post, a three way post, a four-way post in glazed elevations and also as a sill for fully glazed modules. It can also be used as a two-way, three-way or four-way door post. Also, with the use of infill types FW3, FW4, FW5, it becomes a multi-functional glazed and door way post. It eliminates the need for a small solid module to be constructed to form a three way which is able to have two door modules, one either side.

Referring more particularly to FIGS. 12.1 to 12.11, some exemplary applications of the modified universal section FW11 are there illustrated. FIGS. 12.1, 12.2 and 12.3 respectively, show glazed, door and solid panel connections to the FW11 modified universal section, the FW11 being shown secured to a wall, ceiling or other surface, and with respective other components clipped to it in a manner familiar from the foregoing descriptions of the usefulness of the FW1 section. FIGS. 12.4, 12.5 and 12.6 illustrate deep transom arrangements respectively for glazing:glazing, glazing-:door and glazing:solid applications, FIG. 12.7 shows a four door post configuration wherein four door infill sections FW5 are clipped to the universal section FW11, and FIG. 12.8 shows a blank end to a double wall panel with opposed doors. FIG. 12.9 shows a mullion with four glazed sides, two double-glazed and two single-glazed, FIG. 12.10 shows a sill construction and FIG. 12.11 shows a double-glazed corner. It is not considered that any further description of the various applications of the FW11 section is necessary.

The fixing clips FS1 and FS2 of FIGS. 10.1 to 10.4 and FS3 and FS4 of FIGS. 10.5 to 10.8 enable panel sections to be butted at joints without gaps and avoids the requirement which commonly arises with conventional partitioning systems for cover strips to be provided in order to conceal such joints. Moreover, the use of such clips produces a sound- and fire-rateable system which can be erected quickly while remaining fully demountable. The clips FS2 and FS4 can be used on their own and, in such an arrangement, clips are provided at appropriately spaced locations along the respective panel edges constituting the opposed sides of a panel joint, the clips each being fixed to the respective panel edge simply by knocking the teeth 16 into the panel edge. One side of the joint is then fixed to a supporting metal stud by pop riveting the respective clip portions 18 to the stud, and the other side of the joint is butted with the first side with the portions 18 of its clips inserted behind the previously fixed panel and between the panel and the stud. Alternatively, and with the avoidance even of the necessity of riveting any of the clips to the supporting steel stud, the clips FS2 and FS4 can be used in conjunction with the clips FS1 and FS3, the last mentioned clips being knocked into the edge of one panel and then being clipped over the lip of the steel stud so as to hold the first panel in place, the lip of the stud being gripped by the spring portions 18 of the respective clips. The second panel fitted with the FS2 or FS4 type clips can then be butted with the first panel and retained as described above. The second method which makes use of the clips FS1 and FS3 is to be preferred in that it obviates the need for secondary fixings (pop rivets, etc.). The present invention is, of course, not limited to the use of clips such as FS1 to FS4, and standard clamping and cover strips known in the art may be used to provide an acceptable finish at panel joints. FIG. 10.9 shows a sectional view of a joint made by use of clips FS3 and FS4 between panel edges 21 and 22 supported by metal stud 20.

The sections FW9 and FW10 of FIGS. 9.1 and 9.2 are aluminum sections for use as a corner or reducing section for different sized boards such as ½" and ¾" boards, respectively. The conventional practice to finish a corner is to face fix both boards with edges overlappiing to the steel studding, and then to use an aluminum angle which is counter-sunk and then face fixed to cover the panel joint; alternatively, with the use of a clamping strip fixed to the face, then a clip on corner section can be applied. A corner is constructed in the system of the invention by using FW9 or FW10 as shown in FIG. 13.1. One panel 21 is first fixed flush with the edge of the steel (corner) stud 20 with several screws. The FW9 (FW10) is fixed with pop rivets to the exposed steel stud 20 through its center tongue 30, with the leg 31 at right angles to this tongue in contact with the fixed board 21. The following board 22 is slid inside the lip 32 of the FW9 (FW10). No fixings are made on the surface at all. FIG. 13.1 illustrates the formation of a double panelled corner with a second steel stud 20' secured to panels 21' and 22' and an aluminum cover strip FW12 clipped over a steel section 33.

FIG. 13.2 illustrates an alternative use for the sections FW9 or FW10 in providing a frame for a reduced width panel section.

Figure 19:
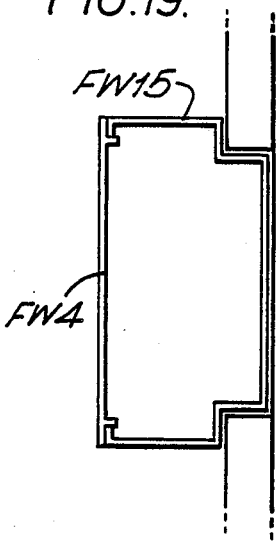
FIG. 19 illustrates an application of the deep wiring duct of FIG. 16.
Figure 20:
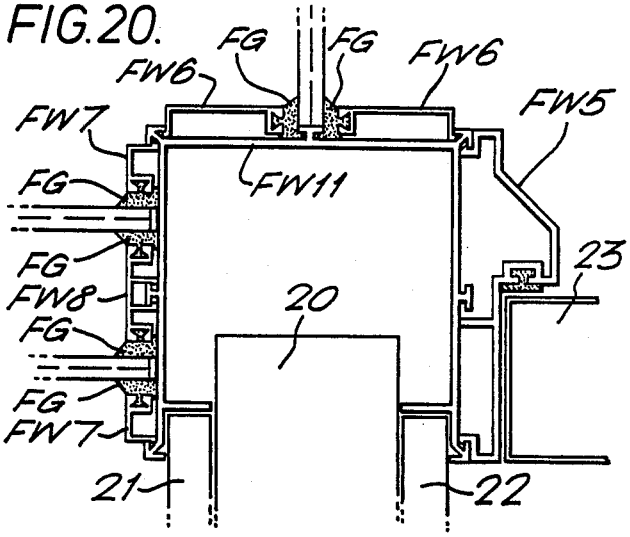
FIG. 20 illustrates the versatility of the system according to the invention.

FIGS. 14, 15 and 16 are sectional views of further extruded aluminum components which can be used in a demountable partitioning configuration constructed in accordance with the teachings of the present invention, particularly (though not exclusively) as ducts for wiring. FIG. 17.1 shows a double panelled wall provided with a wiring duct at dado height on both sides, the wiring ducts each comprising a section FW13 as illustrated in FIG. 14 closed by means of a blank section FW4 of FIG. 4. FIG. 17.2 shows a similar arrangement with the wiring duct at skirting level. As will be seen, the wiring duct FW13 is internally divided so as to enable telephone lines to be ducted separately from power lines. FIG. 18 shows the wiring duct FW14 enlarged to form a twin duct by addition of a section FW14 of FIG. 15, and FIG. 19 shows use of the section FW15 of FIG. 16 as a deep wiring duct for example at dado height. It will be noticed that the wiring duct FW14 of FIG. 15 is engageable directly with the universal sections FW1 and FW11, as may be desirable in certain situations.

The system according to the invention has many advantages over previously known systems in which a standard glazing section has only one function, which is either to form a single or double glazed elevation. To change from one to the other is a major operation which entails taking out all the glazing frames and replacing them with completely new glazing frames. It is also very difficult in such prior art systems to change from 4 mm glass, to 10 mm glass and impossible to use 10 mm glass in double glazed applications without modification to standard sections. In the system according to the invention, FW1 (and FW3-double sided) forms the main glazing frame, and to change from single to double glazing is accomplished by merely substituting FW7 and FW8 for FW6, and vice versa. Differences in glass thickness are accommodated by a change of glazing bead (FG1 and FG2) which fits any glazing.

The fire rating of glazed modules using standard known systems involves the removal of all complete glazing frames, the fixing of steel angle on either side of the glass, and then the replacement of the glazing frames. With the system of the invention, to fire rate glazed modules it is necessary simply to unclip FW6, FW7 or FW8 from FW1, fix the steel angle in position against the glazing stool 5, and then replace FG1 with FG3 before refixing FW6. In the whole procedure the main section FW1 and the infill FW3 (where applicable) is not removed at all.

It is expected that the cost of the component parts of a system according to the invention will be no more and very probably less than those of comparable sound and fire rated systems, and that a substantial saving on installation time will be obtained. Furthermore, since secondary fixings (bolts, screws, rivets, etc.) are to a great extent not used and the different constituent sections merely snap together, the re-usability of demounted partition walling should be considerably enhanced, with consequent substantial savings in cost.

I claim:

1. A universal section for a demountable partitioning system, said universal section comprising an elongate channel-shaped member (FW1; FW11) of constant generally rectangular cross-section throughout its length such as to have only one open side, a side wall (1) opposed thereto and two other wide walls (2) generally perpendicular to the first-mentioned side wall (1), said member having formations (4, 5; 12, 5) associated with at least that one (1) of its three side walls which is opposed to said open side, said formations being such as to enable another elongate member (FW3; FW4; FW5) having complementary formations (8; 10) to be engaged with said at least one side wall in a snap-fit manner and furthermore being such as to enable glazing to be effected to such side wall by means of elongate glazing elements (FW6; FW7; FW8) and associated glazing beads (FG), said formations (4, 5; 12, 5) comprising a glazing stool (5) provided between the longitudinal edges of the respective side wall (1; 1, 1) and spaced-apart formations (4; 12) provided at the longitudinal edges of the respective side wall (1; 1, 2), said glazing stool (5) defining a seating for a glazing pane and furthermore defining with said spaced-apart formations (4), 12) opposed abutments for locating a glazing element (FW6) and associated glazing head (FG) on each side of a glazing pane seated at said glazing stool (5), the said member further having formations (3; 12) provided at the longitudinal edges of the open side of the channel-shaped member (FW1; FW11) which are at least functionally the same as those provided at the longitudinal edges of the side wall (1) opposite thereto for enabling enother elongate member (FW3; FW4; FW5) as aforesaid to be engaged also with said open side in a snap-fit manner, the arrangement thereby being such that another elongate member (FW3, FW4, FW5) as aforesaid may be engaged with at least one of said open side of the elongate channel-shaped member (FW1; FW11) and the side wall (1) thereof which is opposed to said open side.

2. A universal section according to claim 1 wherein similar formations (3; 12) are associated with the open side of the channel-shaped member (FW1; FW11) for enabling said another elongate member (FW3; FW4; FW5) to be engaged also with said open side in a snap-fit manner.

3. A universal section according to claim 1 wherein some (4; 12) at least of said formations (4,5; 12,5) are provided adjacent the elongate edges of said elongate channel-shaped member (FW1; FW11).

4. A universal section according to claim 3 wherein the formations (4; 12) associated with a respective side wall (1; 1,2) of the generally-rectangular channel-shaped member (FW1; FW11) extend generally from the opposed edges of the respective side towards each other, and such formations each define a lip with which a complimentarily-shaped formation (8,10) can be engaged.

5. A universal section according to claim 4 wherein each said formation (4; 12) comprises a portion extending outwardly from the respective side wall (1; 1,2) of the elongate channel-shaped member (FW1; FW11) and a portion spaced from the respective wall (1; 1,2) by the outwardly-extending portion and extending generally parallel to the respective wall.

6. A universal section according to claim 1 in combination with glazing elements (FW6; FW7; FW8) and associated glazing beads (FG) engaged with at least one of the side walls (1; 1,2) of the universal section.

7. A universal section according to claim 1 in combination with glazing elements (FW6) and associated glazing beads (FG) engaged with at least one of the side walls (1; 1,2) of the universal section (FW1; FW11), a single glazing pane being supported by said glazing stool (5) and a glazing element (FW6) and associated glazing bead (FG) being abutted with each side of the glazing pane and engaged between the glazing stool (5) and a spaced apart formation (4; 12) on the respective side wall (1; 1,2) of the elongate channel-shaped element (FW1; FW11).

8. A universal section according to claim 1 in combination with glazing elements (FW7; FW8) and associated glazing beads (FG) engaged with at least one of the side walls (1; 1,2) of the universal section (FW1; FW11), said glazing elements comprising an inner element (FW8) engaged with the glazing stool (5) and having associated glazing beads (FG) on both sides thereof each abutting a respective pane of two panes of double glazing, the inner element (FW8) being between the two panes, and first and second outer glazing elements (FW7) each with an associated glazing bead (FG) abutting a respective one of the glazing panes and engaged between the respective pane and a spaced apart formation (4; 12) on the respective wall (1; 1,2) of the universal section (FW1; FW11).

9. A universal section according to claim 1 in combination with at least one other elongate member (FW3; FW4; FW5) having formations (8, 10) complementary to and engaged with the formations (3,4; 12) provided on at least one of (i) a respective side wall (1; 1,2) and (ii) the open side of the channel-shaped member (FW1; FW11), the at least one other elongate member (FW3; FW4; FW5) thereby being engaged with the universal section.

10. A universal section combination according to claim 9 wherein said at least one other elongate member (FW3; FW4; FW5) engaged with the elongate channel-shaped member is selected from (a) a glazing section (FW3) engageable with the elongate channel-shaped member (FW1; FW11) to enable glazing to be effected to at least one of (i) a side wall of the channel-shaped member which is not inherently adapted for glazing and (ii) the open side of the channel-shaped member, (b) a blank end section (FW4) engageable wiyth at least one of (i) a side wall of the channel-shaped member (FW1; FW11) and (ii) the open side thereof to convert the same into a plain side wall, (c) a door section (FW5) engageable with at least one of (i) a side wall and (ii) the open side of the channel-shaped member (FW1; FW11) to define a door abutment, and (d) a ducting section (FW14).

11. A universal section combination according to claim 10 wherein said glazing section (FW3) is provided with a first set of formations (8) engageable with complementarily-shaped formations (3,4; 12) on at least one of the universal section side wall and open side for engaging the glazing section with the universal section (FW1; FW11), and is provided furthermore with a second set of formations (4,5) engageable with glazing elements (FW6; FW7; FW8) to enable glazing to be effected to said glazing section (FW3).

12. A universal section combination according to claim 11 wherein said second set of formations comprises a glazing stool (5) intermediate the glazing section (FW3) and extending along the length thereof and formations (4) along the edges of the glazing section (FW3) on both sides thereof spaced from the glazing stool (5), the arrangement being adapted to enable both single glazing and double glazing to be effected to the glazing section (FW3), single glazing being effected by supporting the edge of a glazing pane on the glazing stool (5) and, on both sides of the pane, engaging a glazing element (FW6) with an associated elastomeric glazing bead (FG) between the glazing stool (5) and the formation (4) extending along the adjacent edge of the glazing section (FW3), and double glazing being effected by use of an inner glazing element (FW8) between the two panes of the double glazing and two outer glazing elements (FW7) each engaged between a respective one of the glazing panes and the adjacent formation (4) along the edge of the glazing section (FW3), the inner glazing element (FW8) being engageable with the glazing stool (5) and having associated glazing beads (FG) on both sides thereof and the outer glazing elements (FW7) each having an associated glazing bead (FG) on one side only.

13. A universal section combination according to claim 12 comprising a said universal section (FW1; FW11), a said glazing section (FW3) engaged with at least one side of the universal section (FW1; FW11), and one of single-glazing and double-glazing glazing elements (FW6; FW7; FW8) and associated glazing beads (FG) engaged with the glazing section (FW3) for effecting one of single-glazing and double-glazing respectively to the said glazing section (FW3).

14. A universal section or universal section combination according to claim 1 wherein the universal section (FW1) has at least one plain wall (2), and wherein a plain wall glazing section (FW2) comprised of an elongate planar element provided with formations (4,5) to enable glazing to be effected to the element (FW2) is secured to the plain wall (2) of the universal section (FW1).

15. A universal section combination according to claim 14 wherein the plain wall glazing section (FW2) comprises a glazing stool (5) intermediate formations (4) extending along the edges of the section, the arrangement being adapted to enable a glazing pane supported on the glazing stool (5) to be engaged between glazing elements (FW6) and associated glazing beads (FG) introduced between the glazing stool (5) and respective ones of the formations (4) along the edges of the plain wall glazing section (FW2).

16. A universal section combination according to claim 15 wherein a said plain wall glazing section (FW2) is secured to at least one plain wall (2) of the universal section (FW1), and a glazing pane is glazed to said plain wall glazing section (FW2) by means of a pair of said glazing elements (FW6) and associated glazing beads (FG).

17. A universal section combination according to any one of claims 6, 13 and 16 including a fire-resistant angles extending beneath said glazing beads (FG) and between the glazing beads (FG) and the glazing panes.

18. A universal section according to claim 1 wherein said at least one of said other two side walls (2) of said elongate channel-shaped member (FW11) is provided with formations (12) and glazing stools (5) identical to those provided on said at least one side wall (1).

19. A demountable partition comprising partition sections selected from the single-glazed glazing panels, double-glazed glazing panels, solid wall panels, and doors, in combination with multiple-function universal sections (FW1; FW11) according to claim 1 constituting primary supports for the partition sections and interfacing with respective ones of the partition sections by means of interfacing sections (FW2,FW3,FW4,FW5,FW6,FW7,FW8,FW14) clipped to respective side walls of the universal sections (FW1; FW11) in snap-fit manner, the universal sections (FW1; FW11) and the interfacing sections (FW2,FW3,FW4,FW5,FW6,FW7,FW8,FW14) being provided with complementarily-shaped inter-engageable formations (3,5,5,12; 8,10) for enabling such clipping together of the respective sections, and the interfacing sections being selected from the group comprising single-glazing and double-glazing glazing sections (FW2,FW3,FW6,FW7,FW8), blanking sections (FW4), door frame sections (FW5), and ducting sections (FW14).

20. A demountable partition according to claim 19 wherein the universal sections (FW1; FW11) comprise vertical and horizontal support elements of the partition and wherein glazing panes, solid wall panels and doors are supported by means of respective universal sections.

21. A demountable partition according to claim 19 wherein two wall panels (21,22) are joined at corners by means of a corner section (FW9; FW10) comprising an elongate member of substantially constant cross-section throughout its length, such cross-section being generally T-shaped with a limb depending from one end of the crossbar of the T generally parallel to the upright of the T, such limb defining with the upright of the T a channel closed at one side by part of the crossbar of the T for receiving the edge of a first panel to be joined at the corner, and the remainder of the crossbar of the T to be abutted with the edge of the second panel to be joined at the corner.

22. A demountable partition according to claim 19 wherein a solid wall section of the partition is constituted by first and second wall panels (21',22') disposed face to face with a small spacing and at least one edge of said solid wall section is finished by means of an elongate member (FW9; FW10) of substantially constant cross-section throughout its length, such cross-section being generally T-shaped with a limb depending from one end of the crossbar of the T generally parallel to the upright of the T, such limb defining with the upright of the T a channel closed at one side by part of the crossbar of the T and within which the edge of one of said wall panels is received, and the edge of the other of said wall panels being butted with the remainder of the crossbar of the T on the other side of the upright of the T with the respective panel extending generally parallel with the crossbar of the T.

23. A demountable partition according to claim 19 wherein a solid wall section of the partition incorporates a wiring duct (FW13; FW14; FW15).

24. A demountable partition according to claim 19 wherein a butt joint between two solid wall panels (21,22) extending generally in the same plane is secured by means of clips (FS1; FS2; FS3; FS4) knocked into the abutting edges of the panels, the clips associated with one of the panels being secured to a joint support member (20) and the clips associated with the second panel having portions (18) retained between the first panel and the support member (20).

25. A demountable partition according to claim 24 wherein the clips (FS1; FS3) secured to the joint support member (20) comprise spring clamping elements (18) for clamping to the joint support member without need for secondary fixings.

26. A demountable partition according to claim 19 wherein a solid wall section comprises first and second solid wall panels (21,22) face-to-face and spaced apart from each other, the edges of the two panels (21,22) at least at one edge of the solid wall section being received within the open side of a said elongate channel-shaped member (FW1; FW11).

27. A universal section (FW1; FW11) for a demountable partitioning system, said section (FW1; FW11) comprising an elongate channel-shaped member of generally rectangular cross-section having a base wall (1), a pair of side walls (2) and an open side, a glazing stool (5) extending longitudinally of the channel-shaped member (FW1; FW11) on the outer side of the base wall (1) intermediate the two side edges of the base, the said glazing stool (5) being undercut on both sides facing the edges of the base, and a pair of formations (4; 12) being provided extending along the two side edges of the base wall (1) externally of the channel-shaped member (FW1) the said formations (4; 12) being undercut on their sides facing towards the undercut sides of the glazing stool (5), and formations (3; 12) being provided at the edges of the two side walls (2) of the channel-shaped member between which the open side of the channel-shaped member is defined, the formations (4) at the external edges of the base wall (1) being spaced apart from one another a distance substantially equal to the spacing apart of the formations (3; 12) at either side of the open side of the channel-shaped member (FW1; FW11) and being similarly shaped thereto for enabling the attachment to at least one of the base wall (1) and to the open side of the channel shaped member (FW1; FW11) of similarly configured further members (FW3; FW4; FW5) having complementary formations (8,10).

28. A universal section according to claim 27 wherein the two side walls (2) of the channel-shaped member (FW11) have external formations (12,5) the same as those of the base wall (1).

29. A universal section according to claim 27 or 28 in combination with at least one other section having formations complementary to the formations on the elongate channel-shaped member (FW1; FW11) said at least one other section (FW2–FW8) being engaged with at least one of the walls of the elongate channel-shaped member and the open side thereof by snap-fitting together of the complementary formations of the respective parts, said at least one other section being selected from the group consisting of:

(a) single-glazing glazing elements (FW6) each with an associated glazing bead (FG) and comprising an elongate element adapted to be snap-fitted between the undercut of a glazing stool (5) and the facing undercut of an edge formation (4; 12) for locating a glazing pane supported on said glazing stool (5);

(b) double-glazing glazing elements (FW7,FW8) comprising an elongate inner glazing element (FW8) having associated glazing beads (FG) along both edges and elongate outer glazing elements (FW7) having an associated glazing bead (FG) along one edge only, the inner glazing element (FW8) being adapted to be engaged with a glazing stool (5) between two glazing panes and the outer glazing elements (FW7) being adapted to be engaged with the undercut of a respective edge formation (4; 12) and between such formation and a respective one of the two glazing panes;

(c) glazing infill elements (FW3) comprising elongate and generally planar strip-like elements having on one side thereof formations (8) engageable with the formations (4,3; 12) of the channel-shaped member (FW1; FW11) and on the other side thereof formations substantially the same as the formations (4,5; 12,5) provided at least on the base wall (1) of the channel-shaped member (FW1; FW11);

(d) blank end sections (FW4) comprising elongate and generally planar elements having on one side thereof formations (8) engageable with the formations (4,3; 12) of the channel-shaped member (FW1; FW11), the other side being plain;

(e) door infill sections (FW5) comprising elongate elements having on one side formations (10) engageable with the formations (4,3; 12) of the channel-shaped member (FW1; FW11) and on the other side being shaped to define an abutment for a door; and (f) wiring ducts (FW14) comprising generally channel-shaped elongate elements provided with formations engageable with the formations (4,3; 12) of the channel-shaped universal section (FW1; FW11).

30. A universal section according to any one of claims 1, 2, 3 to 5, 6 to 9, 18 and 28 wherein the respective glazing elements (FW6; FW7; FW8) and associated glazing beads are associated with each other non-integrally.

* * * * *